US012774610B2

(12) United States Patent
Lan et al.

(10) Patent No.: US 12,774,610 B2
(45) Date of Patent: Oct. 27, 2026

(54) POOL AND MANUFACTURING METHOD THEREOF

(71) Applicant: DONGGUAN POLYFILM PLASTIC PRODUCTS COMPANY LIMITED, Dong Guan City (CN)

(72) Inventors: Chao Long Lan, Dong Guan City (CN); Hong Teng Zhou, Dong Guan City (CN); Jun Xue Li, Dong Guan City (CN)

(73) Assignee: Dongguan Polyfilm Plastic Products Company Limited, Dong Guan City (CN)

( * ) Notice: Subject to any disclaimer, the term of this patent is extended or adjusted under 35 U.S.C. 154(b) by 209 days.

(21) Appl. No.: 18/607,149

(22) Filed: Mar. 15, 2024

(65) Prior Publication Data

US 2025/0290338 A1 Sep. 18, 2025

(51) Int. Cl.
*E04H 4/00* (2006.01)

(52) U.S. Cl.
CPC ..... *E04H 4/00* (2013.01)

(58) Field of Classification Search
CPC ..... E04H 4/00; E04H 4/0025; E04H 4/0056
USPC ..... 4/513, 506, 494; 482/55
See application file for complete search history.

(56) References Cited

U.S. PATENT DOCUMENTS 4,543,872 A * 10/1985 Graham ..... F42D 5/045 109/1 R
4,802,734 A * 2/1989 Walter ..... E04H 15/22 52/2.25
5,379,467 A * 1/1995 Lochbaum ..... A63B 69/125 4/507
6,071,213 A * 6/2000 Raasch ..... E04H 4/0056 482/29
9,050,489 B2 * 6/2015 Bell ..... A63B 21/4009
2007/0039094 A1 * 2/2007 Peterson ..... E04H 4/0025 4/506
2016/0096598 A1 * 4/2016 Harkrider ..... B63B 34/52 441/130
2020/0295469 A1 * 9/2020 Fenn ..... H01Q 19/19
2024/0218692 A1 * 7/2024 Yao ..... E04H 15/40
2025/0314083 A1 * 10/2025 Zhang ..... E04H 4/0056
(Continued)

FOREIGN PATENT DOCUMENTS

CN 201232374 Y * 5/2009 ..... E04H 4/0056
CN 103953209 A * 7/2014 ..... E04H 4/0031
CN 204475913 U * 7/2015 ..... E04H 4/0056
(Continued)

*Primary Examiner* — Lori L Baker
(74) *Attorney, Agent, or Firm* — Finnegan, Henderson, Farabow, Garrett & Dunner LLP

(57) ABSTRACT

A pool and a manufacturing method thereof. The pool includes a bottom sheet and a wall sheet. The bottom sheet forms a bottom wall of the pool. The wall sheet is arranged along and connected to an outer edge of the bottom sheet. Two opposite ends of the wall sheet are connected together to form as a side wall of the pool. The wall sheet includes a wall sheet body provided with an opening and a patch. The opening extends to at most a side of the wall sheet body. The patch is connected to a portion of the wall sheet body near the opening and covers the opening. The pool and the manufacturing method thereof can reduce the production process and improve the production efficiency.

17 Claims, 5 Drawing Sheets

(56) References Cited

U.S. PATENT DOCUMENTS

2025/0314087 A1* 10/2025 Zhang ..... E04H 4/0056

FOREIGN PATENT DOCUMENTS

| | | | | | | |
|---|---|---|---|---|---|---|
| CN | 205589792 | U | * | 9/2016 | ..... | E04H 4/0056 |
| CN | 208702219 | U | * | 4/2019 | ..... | E04H 4/0056 |
| CN | 209114919 | U | * | 7/2019 | ..... | E04H 4/0056 |
| CN | 209277626 | U | * | 8/2019 | ..... | E04H 4/0056 |
| CN | 209360158 | U | * | 9/2019 | ..... | E04H 4/0056 |
| CN | 209874582 | U | * | 12/2019 | ..... | E04H 4/0056 |
| CN | 210530424 | U | * | 5/2020 | ..... | E04H 4/0056 |
| CN | 111655954 | A | * | 9/2020 | ..... | E04H 4/14 |
| CN | 111836939 | A | * | 10/2020 | ..... | E04H 4/14 |
| CN | 115162793 | A | * | 10/2022 | ..... | E04H 4/12 |
| CN | 217724070 | U | * | 11/2022 | ..... | A61H 33/6005 |
| CN | 218205986 | U | * | 1/2023 | ..... | E04H 4/0056 |
| CN | 218942691 | U | * | 5/2023 | ..... | E04H 4/0056 |
| CN | 221194453 | U | * | 6/2024 | ..... | E04H 4/0056 |
| CN | 222525961 | U | * | 2/2025 | ..... | E04H 4/0056 |
| EP | 0768441 | A1 | * | 4/1997 | ..... | E04H 4/0025 |
| EP | 4431074 | A2 | * | 9/2024 | ..... | E04H 4/14 |
| JP | 3299272 | B2 | * | 7/2002 | ..... | E04H 15/20 |
| RU | 2244081 | C1 | * | 1/2005 | ..... | E04H 4/0056 |
| RU | 161140 | U1 | * | 4/2016 | ..... | E04H 4/0056 |
| WO | WO-2018042369 | A1 | * | 3/2018 | ..... | E04H 4/103 |
| WO | WO-2022084820 | A1 | * | 4/2022 | ..... | E04H 4/0025 |

* cited by examiner

POOL AND MANUFACTURING METHOD THEREOF

TECHNICAL FIELD

The present disclosure relates to the technical field of pool, and in particular to a pool and a manufacturing method thereof.

BACKGROUND

A ground pool is a product that is mounted on the open ground for adults and children to entertain. The ground pool is widely loved by people because of convenient disassembly and assembly, and good use effect. The conventional pool includes a bottom sheet, a plurality of wall sheets connected in sequence, and a plurality of ring sheets connected in sequence. Ends of the plurality of ring sheets connected in sequence are connected to an outer edge of the bottom sheet, and other ends of the ring sheets connected in sequence are connected to the plurality of the wall sheets connected in sequence. The bottom sheet forms a bottom wall of the pool, and the plurality of the wall sheets connected in sequence form a side wall of the pool. The conventional structure of the pool needs to splice the plurality of wall sheets and the plurality of ring sheets, which needs many processes and has a low production efficiency.

SUMMARY

Accordingly, it is necessary to provide a pool and a manufacturing method thereof that can reduce the manufacturing process and improve the production efficiency.

The present disclosure provides a pool, which includes a bottom sheet and a wall sheet. The bottom sheet forms a bottom wall of the pool, the wall sheet is arranged along and connected to an outer edge of the bottom sheet, and two opposite ends of the wall sheet are connected together to form a side wall of the pool. The wall sheet includes a wall sheet body and a patch. The wall sheet body is provided with an opening. The opening extends to at most a side of the wall sheet body. The patch is connected to a portion of the wall sheet body near the opening and covers the opening.

In an embodiment, the wall sheet body is in an integrally formed structure.

In an embodiment, there are at least two openings. The number of the patches is the same as the number of the openings or an integer multiple of the number of the openings.

In an embodiment, the openings are uniformly distributed on the wall sheet body.

In an embodiment, the opening extends to a side of the wall sheet body.

In an embodiment, the opening extends to a side of the wall sheet body close to the bottom sheet.

In an embodiment, the patch has a shape of a vase that is wide at a middle portion and narrow at two ends, and the opening has a shape in correspondence with the shape of the patch.

In an embodiment, the patch includes a first end, a second end and an intermediate portion between the first end and the second end, and a width of the patch increases gradually from the intermediate portion to the first end and the second end, respectively.

In an embodiment, the patch includes an cover portion configured to cover the opening and a first connection portion at least partially arranged along an outer edge of the cover portion. The first connection portion is connected to a portion of the wall sheet body at an edge of the opening.

In an embodiment, the first connection portion is connected to the wall sheet body by welding.

In an embodiment, a width of the first connection portion is in a range from 2.5 cm to 5 cm.

In an embodiment, the pool further includes an inflatable ring including an air ring portion with a receiving cavity and a second connection portion connected to the air ring portion. The air ring portion is connected to the wall sheet through the second connection portion.

The present disclosure further provides a manufacturing method of a pool, which includes the following steps: forming an opening in a wall sheet body; covering the opening of the wall sheet body with a patch, such that the wall sheet body and the patch jointly form a wall sheet; and connecting a side of the wall sheet to an outer edge of the bottom sheet, and connecting two opposite ends of the wall sheet together to form a side wall of the pool.

In an embodiment, the forming the opening in the wall sheet body includes the following steps: forming a slit in the wall sheet body; and applying forces away from each other to slit walls on both sides of the slit such that the slit forms the opening.

In an embodiment, the manufacturing method further includes the following steps: making an inflatable ring including an air ring portion provided with a receiving cavity, and a second connection portion connected to the air ring portion; and connecting the second connection portion to a side of the wall sheet away from the bottom sheet.

In an embodiment, the making the inflatable ring includes the following steps: providing a tube sheet having a first side, a second side and a fixed portion between the first side and the second side; folding the first side toward the fixed portion and connecting the first side to the fixed portion such that a portion of the tube sheet from the first side to the fixed portion forms an air ring portion having a tubular shape, and a portion of the tube sheet from the second side to the fixed portion forms a second connection portion having a strip shape; and connecting two opposite ends of the air ring portion, and connecting two opposite ends of the second connection portion, so as to form a sealed air ring portion having a ring shape, and a second connection portion having a ring shape.

In an embodiment, the wall sheet body and the patch are connected by welding.

In the present disclosure, the wall sheet of the pool having a desired shape can be constructed by connecting the patch to the wall sheet body, and can connect the wall sheet directly to the bottom sheet without using the ring sheet at the bottom of the side wall of the pool and connecting the wall sheet to the bottom sheet through the ring sheet. The production process of the pool is optimized by omitting the process of splicing ring sheets and connecting the ring sheets to the bottom sheet and the wall sheet respectively, which is conducive to improving the production efficiency of the pool.

BRIEF DESCRIPTION OF THE DRAWINGS

The foregoing and other objects, features and advantages of the present disclosure will become more clear as more particularly explained by the preferred embodiment of the present disclosure shown in the drawings. The same reference numerals in the drawings indicate the same parts in their entirety, and the drawings are not deliberately drawn to the same scale as the actual size, focusing on the purpose of the present disclosure. Other features, objects and advantages of the present disclosure will become more apparent from the detailed description of the non-limiting embodiments with reference to the following drawings.

REFERENCE NUMERAL DESCRIPTION

Figure 1:
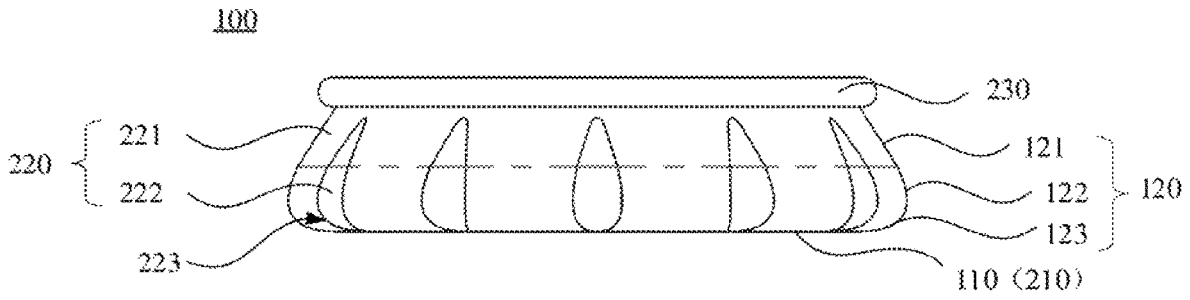
FIG. 1 is a front view of a pool in an embodiment.
Figure 2:
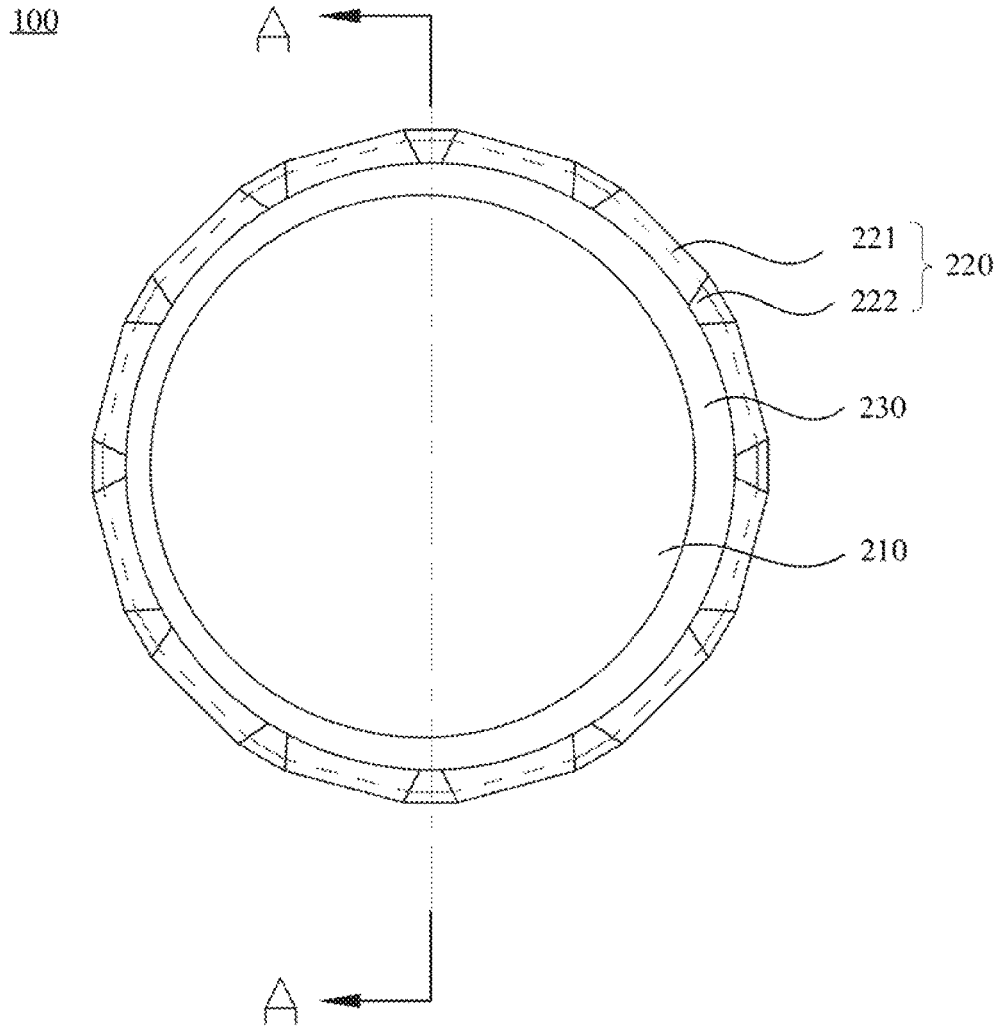
FIG. 2 is a top view of the pool in FIG. 1.
Figure 3:
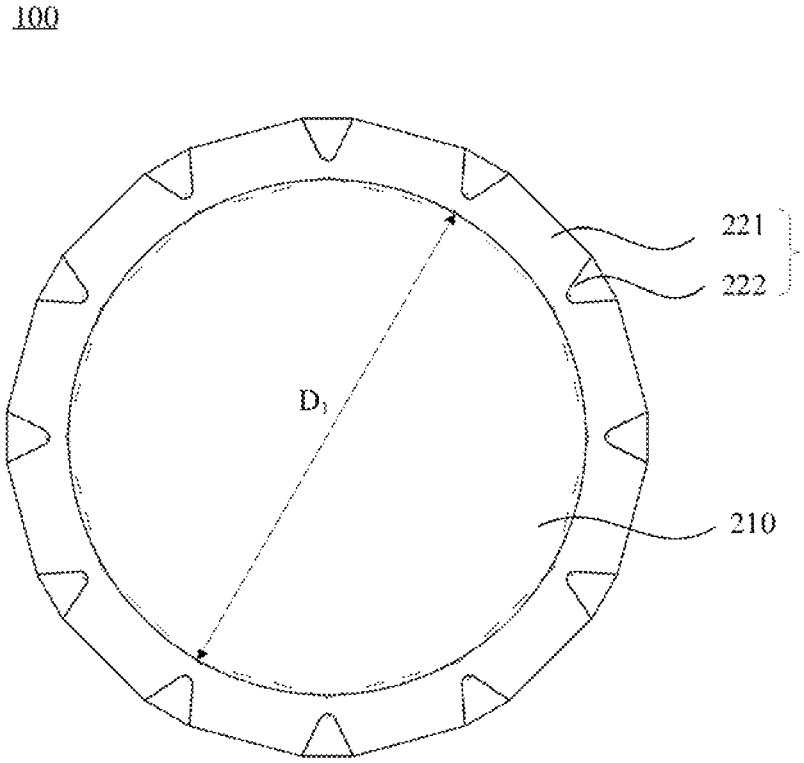
FIG. 3 is a bottom view of the pool in FIG. 1.

100: pool; 110: bottom wall; 120: side wall; 121: flat section; 122: first curved section; 123: second curved section; 210: bottom sheet; 220: wall sheet; 221: wall sheet body; 222: patch; 2221: first end; 2222: second end; 2223: intermediate portion; 2224: first connection portion; 2225: cover portion; 223: opening; 224: slit; 230: inflatable ring; 231: air ring portion; 232: second connection portion; 233: receiving cavity; 240: tube sheet; 241: first side; 242: second side; 243: fixed portion.

DETAILED DESCRIPTION OF THE EMBODIMENTS

In order to facilitate the understanding of the present disclosure, the present disclosure will be described more fully hereinafter with reference to the related accompanying drawings. Preferred embodiment of the present disclosure is given in the drawings. However, the present disclosure may be embodied in many different forms and is not limited to the embodiments described herein. Conversely, the purpose of providing these embodiments is to make the disclosure of the present disclosure more thorough and comprehensive.

It should be noted that when one element is considered to be "connected" to another element, it may be directly connected to and incorporated with the other element, or it may exist simultaneously as a central element. The terms "mounting," "one end," "another end" and similar expressions used in this article are for illustrative purposes only.

All technical and scientific terms used herein have the same meaning as commonly understood by skilled person in the art to which the present disclosure belongs, unless otherwise defined. The terms used herein in the description of the present disclosure are for the purpose of describing specific embodiments only, and are not intended to limit the present disclosure. The term "and/or" used herein includes any and all combinations of one or more of the associated listed objects. Reference will be made to the accompanying drawings and embodiments to describe the present disclosure in detail, so that the objects, technical solutions and advantages of the present disclosure can be more apparent and understandable. It should be understood that the specific embodiments described herein are only used to explain the present disclosure, but not to limit the present disclosure.

The present disclosure provides a pool 100, which may be made of a flexible waterproof material such as gripper mesh, PVC, etc. for reserve, storage and transportation. The pool 100 has a folded state and a deployed state. FIG. 1 is a schematic diagram of a pool 100, where the pool 100 is in the deployed state, that is, the pool 100 is in a use state after the water is stored. The pool 100 may be used to hold water for entertainment, bathing or swimming, etc. The pool 100 may also be used to hold other liquids, sand, etc., which is not restricted in the present disclosure.

In an embodiment, as shown in FIGS. 1 to 4, the pool 100 includes a bottom sheet 210 and a wall sheet 220 arranged along and connected to an outer edge of the bottom sheet 210. The bottom sheet 210 has a substantially circular shape. The bottom sheet 210 forms a bottom wall 110 of the pool 100. Both end of the wall sheet 220 are connected to form a side wall 120 of the pool 100. A diameter D1 of the bottom wall 110 of the pool 100 ranges from 1.5 m to 5.5 m, such as 1.6 m, 2 m, 2.8 m, 3.1 m, etc. A diameter $D_{max}$ at the maximum diameter position of the pool 100 is in a range of 1.8 m to 6.1 m, such as 2 m, 2.4 m, 3.3 m, 3.65 m, etc. A height H of the pool 100 ranges from 0.5 m to 1.5 m, such as 0.85 m, 0.91 m, 1.1 m, 1.3 m, etc. The range of values listed above for D1, $D_{max}$ and H and the specific values are for example only, and D1, $D_{max}$ and H can also be set to other appropriate values according to actual needs.

Figure 4:
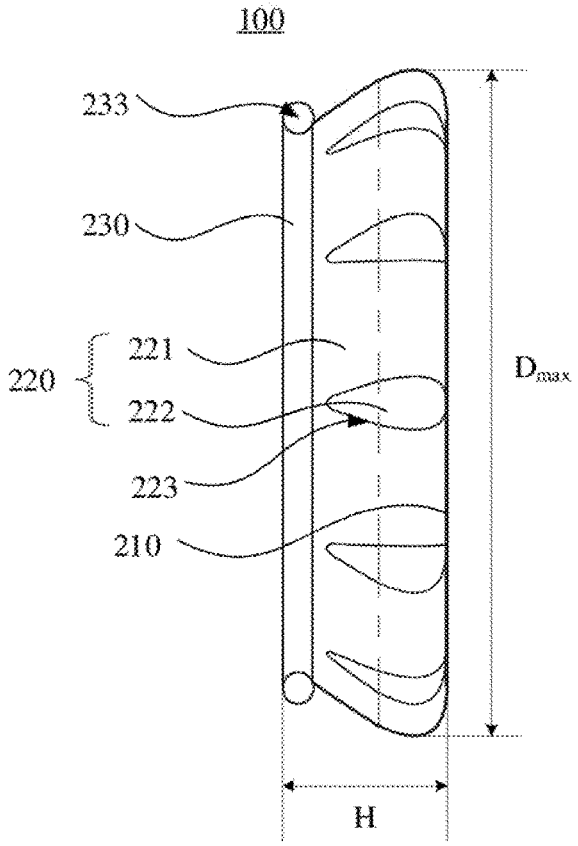
FIG. 4 is a cross-sectional view along line A-A of FIG. 2.

Referring to FIGS. 1 and 4, a bottom wall 110 of the pool 100 is substantially flat and can be placed on the flat ground, and the bottom wall 110 of the pool 100 has a substantially circular shape. In a direction from top to bottom, the side wall 120 of the pool 100 is first inclined outwards and remains essentially flat, then gradually begins to bend inwards as it approaches the bottom wall 110, and finally is connected to an edge of the bottom wall 110 of the pool 100. Specifically, the side wall 120 of the pool 100 includes a flat section 121 provided at a top portion of the side wall 120, a first curved section 122 provided at a middle portion of the side wall 120, and a second curved section 123 provided at a bottom portion of the side wall 120. That is, the wall sheet 220 includes a flat section 121 provided at a top portion of the wall sheet 220, a first curved section 122 provided at a middle portion of the wall sheet 220, and a second curved section 123 provided at a bottom portion of the wall sheet 220. The flat section 121 transitions to the bottom wall 110 via the first curved section 122 and the second curved section 123. In other embodiments, the flat section 121 at the top portion of the side wall 120 may also be curved (see FIG. 5), which is not limited in the present disclosure.

Figure 5:
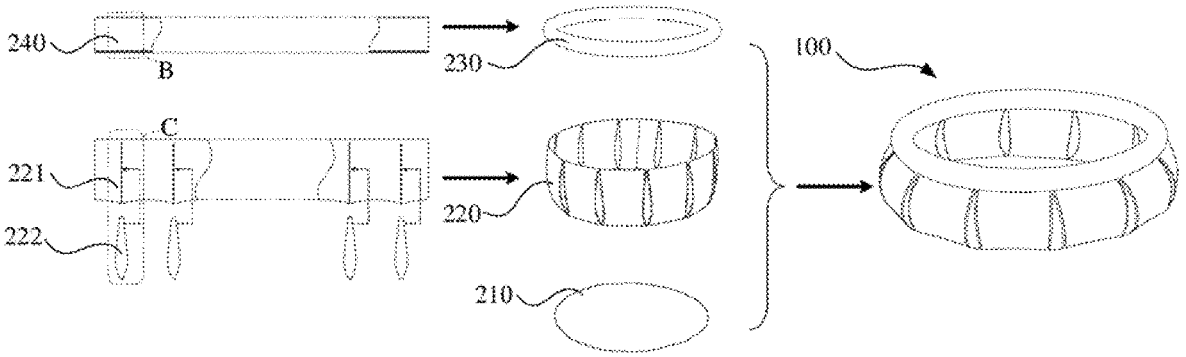
FIG. 5 is a schematic process diagram of a manufacturing method of a pool in an embodiment.
Figure 7:
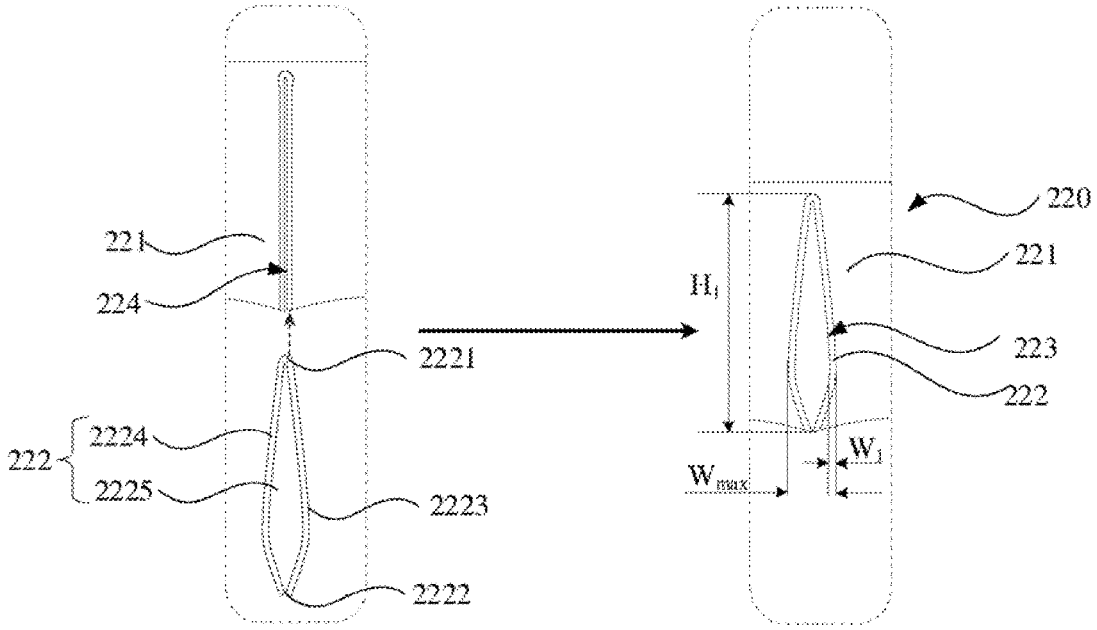
FIG. 7 is a schematic process diagram of the manufacturing method at portion C in FIG. 5.

As shown in FIGS. 1 to 4, the wall sheet 220 includes a wall sheet body 221 and a patch 222. The wall sheet body 221 has an opening 223. The opening 223 mat extend to at most a side of the wall sheet body 221. In this embodiment, the opening 223 is provided between two sides of the wall sheet body 221 and does not extend to any side of the wall sheet body 221. That is, an end of the opening 223 extends to the second curved section 123 but does not extend through the second curved section 123, and another end of the opening 223 extends to flat section 121 but does not extend through the flat section 121. Alternatively, as shown in FIGS. 5 and 7, the opening 223 extends to a side of the wall sheet body 221 close to the bottom sheet 210. The patch 222 is connected to a position of the wall sheet body 221 near the opening 223 and covers the opening 223. In this embodiment, the wall sheet body 221 is in an integrally formed structure, that is, the wall sheet body 221 is in one piece, and the wall sheet 220 is jointly formed by a piece of wall sheet body 221 and a plurality of patches 222, so as to reduce the manufacturing processes of the wall sheet 220. In other embodiments, there may be a plurality of the wall sheet bodies 221, the plurality of wall sheet bodies 221 are interconnected and connected to a plurality of patches 222 to form a wall sheet 220. By connecting the patch 222 to the wall sheet body 221, the wall sheet 220 of the pool 100 having a desired shape can be constructed, and the wall sheet 220 can be directly connected to the bottom sheet 210 without using a ring sheet at the bottom portion of the side wall 120 of the pool 100 and connecting the wall sheet 220 to the bottom sheet 210 through the ring sheet as in the conventional technology. As such, the production process of pool 100 is optimized by reducing the process of splicing ring sheets and connecting the ring sheets to the bottom sheet 210 and the wall sheet 220 respectively, which is conducive to improving the production efficiency of the pool 100. By connecting the patch 222 to the wall sheet body 221, the wall sheet 220 with any desired shape can be obtained, and then the pool 100 with any desired shape can be obtained.

As shown in FIGS. 1 and 4, there are at least two openings 223 in the wall sheet body 221, for example, the number of the openings 223 may be in a range from 6 to 16. The openings 223 are distributed uniformly on the wall sheet body 221, such that each of the openings 223 of the side wall 120 of the pool 100 is capable of being subjected to uniform water pressure. The number of the patches 222 is the same as the number of the openings 223 or an integer multiple of the number of the openings 223. Specifically, the same number of patches 222 is provided at each of the openings 223, that is, one, two or more patches 222 are provided at each of the openings 223, such that the wall sheets 220 near the openings 223 is capable of being subjected to approximately the same water pressure and avoid the rupture of the wall sheet 220 at some openings 223. In other embodiments, a different number of patches 222 may also be provided at each of the openings 223. The shape and the number of the openings 223 and the patches 222 can be adjusted according to actual needs to obtain pools 100 with different shapes.

As shown in FIGS. 5 and 7, the patch 222 has a shape of a vase which is wide at a middle portion and narrow at two ends, and a shape of the opening 223 is in correspondence to the patch 222. Specifically, the patch 222 includes a first end 2221, a second end 2222 and an intermediate portion 2223 provided between the first end 2221 and the second end 2222, and a width of the patch 222 increases gradually from the intermediate portion 2223 to the first end 2221 and the second end 2222 respectively. The maximum width $W_{max}$ of the intermediate portion 2223 of the patch 222 ranges from 18 cm to 23 cm. For example, the maximum width $W_{max}$ of the intermediate portion 2223 may be 18.5 cm, 20 cm, 21 cm, 22.3 cm or others. A height $H_1$ of the patch 222 ranges from 76 cm to 122 cm. For example, the height $H_1$ of the patch 222 may be 80 cm, 85.5 cm, 91 cm, 102 cm or others. As shown in FIG. 7, the patch 222 includes a cover portion 2225 configured to cover the opening 223 and a first connection portion 2224 at least partially arranged along an outer edge of the cover portion 2225, and the first connection portion 2224 is connected to the wall sheet body 221 at an edge of the opening 223. In this embodiment, the first connection portion 2224 is connected to the wall sheet body 221 by welding. A width $W_1$ of the first connection portion 2224 ranges from 2.5 cm to 5 cm. For example, the width $W_1$ of the first connection portion 2224 may be 2.8 cm, 3 cm, 4 cm, 5 cm, or others. The range of values listed above for $W_{max}$, $H_1$ and $W_1$ and the specific values are for example only, and $W_{max}$, $H_1$ and $W_1$ can also be set to other appropriate values according to actual needs.

Figure 6:
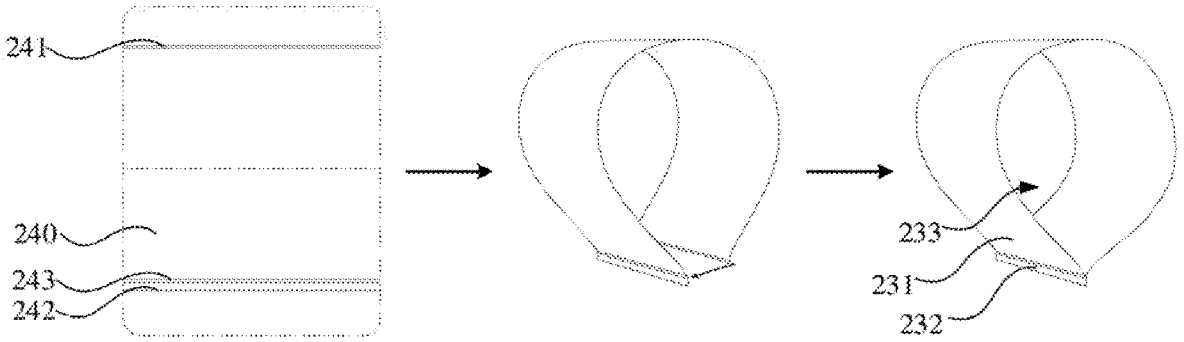
FIG. 6 is a schematic process diagram of the manufacturing method shown at portion B in FIG. 5.

In an embodiment, as shown in FIGS. 1 and 6, the pool 100 also includes an inflatable ring 230, which is made using a tube sheet 240, as depicted by the schematic process of portion B shown in FIG. 5. Inflatable ring 230 includes an air ring portion 231 provided with a receiving cavity 233 (as shown in FIG. 4) and a second connection portion 232 connected to the air ring portion 231. The air ring portion 231 is connected to the wall sheet 220 through the second connection portion. When used, the receiving cavity 233 is first filled with air and then the pool 100 is filled with water. As the water surface rises, the inflatable ring 230 gradually rises under the action of the buoyancy of the water, and simultaneously drives the wall sheet 220 connected thereto to rise together, such that the wall sheet 220 is gradually expanded from the original amorphous flexible state, and finally automatically forms the pool 100 in use as shown in FIG. 1. As mentioned above, the side wall 120 of the pool 100 is first inclined from top to bottom and remains substantially flat, that is, the gradient of the flat section of the pool is designed to be reduced from bottom to top, such that the inflatable ring 230 can always be better subjected to the buoyancy of water.

In other embodiments, the wall sheet 220 may be manually unfolded before the pool 100 is filled with water without providing an inflatable ring 230, and the pool 100 can also be filled for use.

Figure 8:
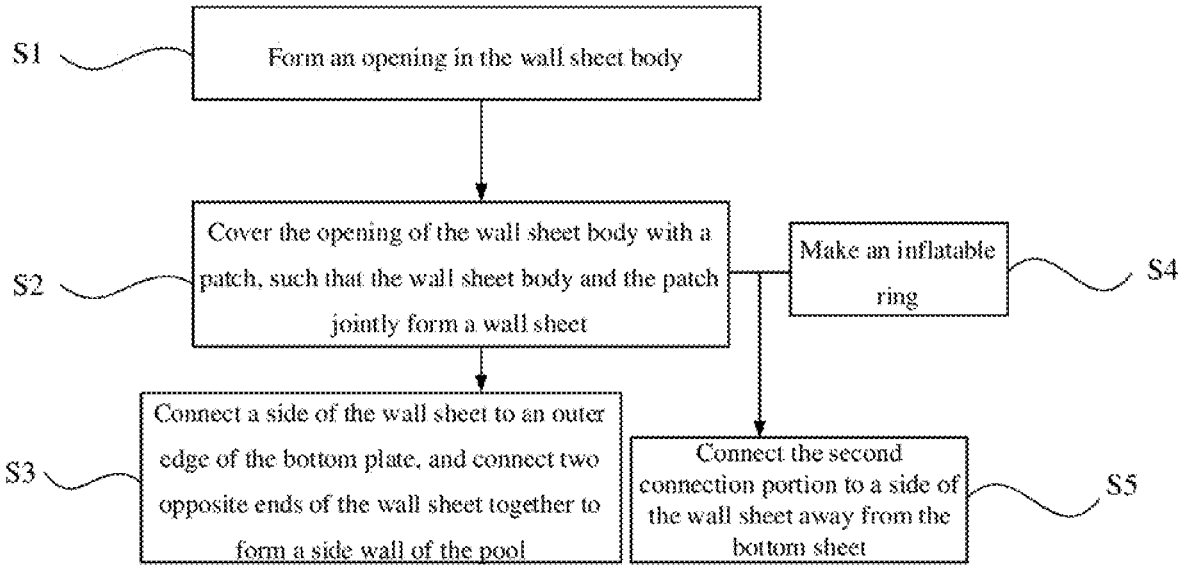
FIG. 8 is a flow chart of a manufacturing method of the pool according to an embodiment.

The present disclosure also provides a manufacturing method for the aforementioned pool 100. As shown in FIG. 8, the manufacturing method includes the following steps.

In step S1, an opening 223 is formed in the wall sheet body 221.

Specifically, step S1 specifically includes the following steps.

In step S11, a slit 224 is formed in the wall sheet body 221, an end of the slit 224 extends to a side of the wall sheet 220 close to the bottom sheet 210, and another end of the slit 224 extends to the flat section 121 of the wall sheet 220.

In step S12, forces away from each other are applied to slit walls on both sides of the slit 224, such that the slit 224 forms the opening 223.

In step S2, the opening 223 of the wall sheet body 221 is covered with the patch 222, such that the wall sheet body 221 and the patch 222 jointly form a wall sheet 220.

Optionally, in step S2, the wall sheet body 221 and the patch 222 are connected by means of high frequency welding, bonding, mechanical connection, welding, etc., In this embodiment, the wall sheet body 221 and the patch 222 are connected by welding.

In step S3, a side of the wall sheet 220 is connected to the outer edge of the bottom sheet 210, and two opposite ends of the wall sheet 220 are connected together to form a side wall 120 of a pool 100.

Optionally, in step S3, the wall sheet 220 and the bottom sheet 210 are connected by means of high frequency welding, bonding, mechanical connection, welding, etc. In this embodiment, the wall sheet 220 and the bottom sheet 210 are connected by welding.

As shown in FIG. 8, in an embodiment, if the pool 100 further includes an inflatable ring 230, the following steps may be included.

In step S4, an inflatable ring 230 is made, which includes an air ring portion 231 with a receiving cavity 233, and a second connection portion 232 connected to the air ring portion 231.

Specifically, step S4 includes the following steps.

In step S41, a tube sheet 240 (as depicted in portion B of FIG. 5, for example) is provided, which has a first side 241, a second side 242 and a fixed portion 243 provided between the first side 241 and the second side 242.

In step S42, the first side 241 is folded toward the fixed portion 243 and connected to the fixed portion 243, such that a portion of the tube sheet 240 from the first side 241 to the fixed portion 243 forms an air ring portion 231 having a tubular shape, and another portion of the tube sheet 240 from the second side 242 to the fixed portion 243 forms a second connection portion 232 having a strip shape.

In step S43, two opposite ends of the air ring portion 231 are connected and two opposite ends of the second connection portion 232 are connected to form a sealed air ring portion 231 having a ring shape, and a second connection portion 232 having a ring shape, respectively.

Optionally, in step S42, the tube sheet 240 may be connected by high frequency welding, bonding, mechanical connection, welding, etc., to form the inflatable ring 230. In this embodiment, the tube sheet 240 is connected by welding.

In step S5, the second connection portion 232 is connected to a side of the wall sheet 220 away from the bottom sheet 210.

Optionally, in step S5, the second connection portion 232 and the wall sheet 220 may be connected by high frequency welding, bonding, mechanical connection, welding, etc., In this embodiment, the second connection portion 232 and the wall sheet 220 are connected by welding.

In the manufacturing method of the pool 100 of the present disclosure, the cutting of the patch 222, the connection of the patch 222 to the wall sheet body 221, and the connection of the wall sheet 220 to the bottom sheet 210 and the inflatable ring 230 can be implemented by an automated machine, so as to improve the production efficiency of the pool 100.

In the manufacturing method of the present disclosure, the wall sheet 220 of the pool 100 having the desired shape can be constructed by connecting the patch 222 to the wall sheet body 221, and the wall sheet 220 can be directly connected to the bottom sheet 210, without using a ring sheet at the bottom of the side wall 120 of the pool and connecting the wall sheet 220 to the bottom sheet 210 through the ring sheet. The production process of pool 100 is optimized by omitting the processes of splicing the ring sheets and connecting the ring sheet with the bottom sheet 210 and the wall sheet 220 respectively, which is conducive to improving the production efficiency of the pool 100 and reducing the production cost of the pool 100.

It should be noted that the azimuth-related terms used in the present disclosure, such as "up," "down," "in," "out," etc., are all relative to the pool being in normal use (as shown in FIG. 1).

The technical features of the aforementioned embodiments may be combined arbitrarily. To simplify the description, not all the possible combinations of the technical features in the aforementioned embodiments are described. However, all of the combinations of these technical features should be considered as within the scope of the present disclosure, as long as such combinations do not contradict with each other.

The aforementioned embodiments only represent several examples of the present disclosure, and the description thereof is more specific and detailed, but it should not be construed as restricting the scope of the present disclosure. It should be noted that, for those skilled in the art, several variations and improvements may be made without departing from the concept of the present disclosure, and these are all within the protection scope of the present disclosure. Therefore, the protection scope of the present disclosure shall be defined by the appended claims.

What is claimed is:

1. A pool comprising:

a bottom sheet forming a bottom wall of the pool; and a wall sheet arranged along and connected to an outer edge of the bottom sheet, wherein two opposite ends of the wall sheet are connected together to form a side wall of the pool, and the wall sheet comprises:

a wall sheet body provided with an opening, wherein the opening extends to at most a side of the wall sheet body; and a patch connected to a portion of the wall sheet body near the opening and covering the opening.

2. The pool according to claim 1, wherein the wall sheet body is in an integrally formed structure.

3. The pool according to claim 1, wherein there are at least two openings, and the number of the patches is the same as the number of the openings or an integer multiple of the number of the openings.

4. The pool according to claim 3, wherein the openings are uniformly distributed on the wall sheet body.

5. The pool according to claim 1, wherein the opening extends to a side of the wall sheet body.

6. The pool according to claim 5, wherein the opening extends to a side of the wall sheet body close to the bottom sheet.

7. The pool according to claim 1, wherein the patch has a shape of a vase that is wide at a middle portion and narrow at two ends, and the opening has a shape in correspondence with the shape of the patch.

8. The pool according to claim 7, wherein the patch comprises a first end, a second end and an intermediate portion between the first end and the second end, and a width of the patch increases gradually from the intermediate portion to the first end and the second end, respectively.

9. The pool according to claim 1, wherein the patch comprises a cover portion configured to cover the opening and a first connection portion at least partially arranged along an outer edge of the cover portion, and the first connection portion is connected to a portion of the wall sheet body at an edge of the opening.

10. The pool according to claim 9, wherein the first connection portion is connected to the wall sheet by welding.

11. The pool according to claim 9, wherein a width of the first connection portion is in a range from 2.5 cm to 5 cm.

12. The pool according to claim 1, further comprising an inflatable ring comprising an air ring portion with a receiving cavity, and a second connection portion connected to the air ring portion, wherein the air ring portion is connected to the wall sheet through the second connection portion.

13. A manufacturing method for a pool, the manufacturing method comprising the steps of:

forming an opening in a wall sheet body;

covering the opening of the wall sheet body with a patch, such that the wall sheet body and the patch jointly form a wall sheet; and connecting a side of the wall sheet to an outer edge of the body sheet, and connecting two opposite ends of the wall sheet together to form a side wall of the pool.

14. The manufacturing method according to claim 13, wherein the forming an opening in the wall sheet body comprises:

forming a slit in the wall sheet body; and applying forces away from each other to slit walls on both sides of the slit such that the slit forms the opening.

15. The manufacturing method according to claim 13, further comprising:

making an inflatable ring comprising an air ring portion provided with a receiving cavity, and a second connection portion connected to the air ring portion; and connecting the second connection portion to a side of the wall sheet away from the bottom sheet.

16. The manufacturing method according to claim 15, wherein the making the inflatable ring comprises:

providing a tube sheet having a first side, a second side and a fixed portion between the first side and the second side;

folding the first side toward the fixed portion and connecting the first side to the fixed portion such that a portion of the tube sheet from the first side to the fixed portion forms an air ring portion having a tubular shape, and a portion of the tube sheet from the second side to the fixed portion forms a second connection portion having a strip shape; and connecting two opposite ends of the air ring portion, and connecting two opposite ends of the second connection portion, so as to form a sealed air ring portion having a ring shape, and a second connection portion having a ring shape.

17. The manufacturing method according to claim 13, wherein the wall sheet body and the patch are connected by welding.

* * * * *